US005540003A

United States Patent [19]

Osadchuk

[11] Patent Number: 5,540,003

[45] Date of Patent: Jul. 30, 1996

[54] PADDING MACHINE WITH SHAKER FOR SEPARATOR

[76] Inventor: Mark Osadchuk, 7520 E. Adobe Dr., Scottsdale, Ariz. 85255

[21] Appl. No.: 278,888

[22] Filed: Jul. 22, 1994

[51] Int. Cl.[6] ..... E02F 5/22

[52] U.S. Cl. ..... 37/142.5; 37/403; 405/179

[58] Field of Search ..... 37/142.5, 195, 37/351, 403; 209/307, 308, 421, 420; 405/179

[56] References Cited

U.S. PATENT DOCUMENTS

| | | | |
|---|---|---|---|
| 1,058,016 | 4/1913 | Renfro . | |
| 1,276,903 | 8/1918 | Green . | |
| 1,397,343 | 11/1921 | Sturtevant . | |
| 1,440,232 | 12/1922 | Muir . | |
| 1,522,724 | 1/1925 | Judson . | |
| 1,560,716 | 11/1925 | Newdick . | |
| 1,681,457 | 8/1928 | Asplund . | |
| 1,690,009 | 10/1928 | Hamilton . | |
| 1,792,148 | 2/1931 | Dobbins et al. . | |
| 1,876,137 | 9/1932 | Engelen . | |
| 2,296,851 | 9/1942 | Henry . | |
| 2,553,072 | 5/1951 | Zeh et al. . | |
| 2,587,918 | 3/1952 | Stout . | |
| 2,624,415 | 1/1953 | Moore . | |
| 2,669,338 | 2/1954 | Kling . | |
| 2,696,287 | 12/1954 | Foust . | |
| 2,725,700 | 12/1955 | Fahrenholz . | |
| 2,751,830 | 6/1956 | Stauffer | 209/308 X |
| 2,814,387 | 11/1957 | McWilliams . | |
| 2,857,691 | 10/1958 | Curran . | |
| 2,860,783 | 11/1958 | Johnson . | |
| 2,947,096 | 8/1960 | Cummings et al. . | |
| 2,974,795 | 3/1961 | Behnke et al. . | |
| 3,316,977 | 5/1967 | Snook . | |
| 3,340,935 | 9/1967 | Csimma . | |
| 3,439,806 | 4/1969 | Kass et al. . | |
| 3,442,381 | 5/1969 | Johnson . | |
| 3,583,168 | 6/1971 | Horton . | |
| 3,701,422 | 10/1972 | Downey . | |
| 3,900,392 | 8/1975 | Speno et al. . | |
| 3,981,089 | 9/1976 | Burrows . | |
| 3,998,396 | 12/1976 | Umphrey et al. . | |
| 4,057,917 | 11/1977 | Burrows . | |
| 4,146,483 | 3/1979 | Lee | 209/308 X |
| 4,262,477 | 4/1981 | Turold et al. . | |
| 4,277,105 | 7/1981 | Taylor . | |
| 4,287,056 | 9/1981 | Dumbaugh et al. . | |
| 4,301,910 | 11/1981 | Price . | |
| 4,363,725 | 12/1982 | Morita et al. . | |
| 4,377,365 | 3/1983 | Layh . | |
| 4,448,257 | 5/1984 | McRae | 209/308 X |
| 4,591,432 | 5/1986 | Hartl . | |
| 4,632,751 | 12/1986 | Johnson et al. . | |
| 4,633,602 | 1/1987 | Layh et al. . | |
| 4,664,791 | 5/1987 | McClain et al. . | |
| 4,795,552 | 1/1989 | Yun et al. . | |

(List continued on next page.)

FOREIGN PATENT DOCUMENTS 2219330 12/1989 United Kingdom .

*Primary Examiner*—Terry Lee Melius
*Assistant Examiner*—Robert Pezzuto
*Attorney, Agent, or Firm*—Crutsinger & Booth

[57] ABSTRACT

An improved padding machine is provided with a shaker assembly that vigorously shakes a moving openwork at a high frequency. The shaker assembly includes resilient mounts for attaching the shaker assembly to the frame of the padding machine, preferably adjacent the supports for an upper portion of the screening belt, which slides across the top of such supports. The rubber or rubber-like resilient mounts support an eccentric shaft that is journalled in associated bearings for rotation beneath an upper portion of the screening belt. The eccentric shaft preferably extends substantially the entire width of the screening belt to either side of the padding machine. A motor is connected to a drive end of the eccentric shaft for rotating the shaft. When the motor rapidly rotates the eccentric shaft, the off-center body of the eccentric shaft causes vibration, which is translated through the resilient mounts to the frame of the padding machine adjacent the supports for the screening belt. Thus, high frequency vibratory motion is imparted to the moving screening belt.

19 Claims, 5 Drawing Sheets

U.S. PATENT DOCUMENTS 4,861,461 8/1989 Utterback .
4,912,862 4/1990 Bishop et al. .
4,948,299 8/1990 Cronk, Jr. et al. .
4,955,656 9/1990 Klamar .
5,084,991 2/1992 Cronk, Jr. .
5,097,610 3/1992 Bishop .
5,120,433 6/1992 Osadchuk .
5,195,260 3/1993 Osadchuk .
5,261,171 11/1993 Bishop .
5,271,168 12/1993 Wilson, Sr. et al. ..... 37/142.5

PADDING MACHINE WITH SHAKER FOR SEPARATOR

TECHNICAL FIELD

This invention relates to padding machines that are useful for burying underground cables and pipelines. A padding machine continuously moves alongside an excavated trench or ditch, elevates excavated material, separates fine padding material from rough material that could damage a cable or pipeline, and transports the padding material into the ditch for padding the cable or pipeline. More particularly, the invention relates to a padding machine having a new shaker assembly for shaking a moving separator grid or screen to increase the amount of fine padding material separated from the excavated material.

BACKGROUND OF THE INVENTION

Underground cables and pipelines are typically emplaced by laying the cable or pipeline in a prepared trench and subsequently backfilling the trench.

Some cables and pipelines are susceptible to damage from stones, rocks, or other hard objects in the backfill material. For example, optical fiber communications cables are considered particularly susceptible to damage in this manner, as are polymeric or plastic pipelines. Also steel pipes are increasingly provided with protective polymeric coatings, which must be protected from penetration or damage by hard objects.

Consequently, in the laying of cables and pipelines it is increasingly sought to backfill the trench with fill material that is relatively free of stones or other hard objects. One way to achieve this is to backfill the trench with sand or other suitable fill material brought from a remote source of sand or rock-free soil. This approach is relatively expensive and time-consuming. Further, where steel pipe is protectively padded with a layer of sand, the filled trench tends to collect standing water in the porous sand fill, leading to premature corrosion of the pipe. Also, the use of a fill material that is different from the surrounding soil results in a loss of cathodic protection, which also leads to premature corrosion of steel pipe.

The alternative is to screen the excavated material dug from the trench, to remove stones and other foreign objects, and return the screened material to the trench. Several machines, known as padding machines, have been disclosed in the prior art for this purpose.

For example, U.S. Pat. No. 2,857,691 to Curran discloses a tracked vehicle having a vertically swingable boom that extends laterally over a trench. The boom includes a tube having an enclosed auger. At the far end of the boom from the vehicle is a rotating head which scoops up soil from alongside the trench, screens the soil, and transmits it to the auger, which conveys the screened soil along the tube and into the trench through openings in the tube. The Curran apparatus is particularly designed for use with a vehicle that is driven along the opposite side of a trench from the pile of soil that was removed from the trench and which extends alongside the trench. One of the major disadvantages of the Curran device is that since the rotating head is attached with boom extending to the side of the tracked vehicle across the ditch, the operation of the rotating head on the far side of the ditch is difficult or impossible to control. Another major disadvantage is that the device occupies both sides of the ditch, causing increased traffic congestion along the narrow right of way of the pipeline.

U.S. Pat. No. 4,633,602, to Layh et al., is an important advance in the pipeline padding art. Layh et al. discloses a pipeline padding machine built on a vehicle frame that operates on one side of the ditch in the excavated material pile. Layh et al. shows the use of a pipeline padding machine having a pivotally mounted gathering head for collecting excavated material and an elevator for moving collected excavated material upwardly and rearwardly to dump the material onto a flat separator screen. Fine material falls through the separator screen onto a lateral conveyor for transporting the fine padding material to the ditch. The angle or tilt of the separator screen can be adjusted to compensate for the grade of upward and downward slopes of the pipeline environment and the type of excavated material to obtain a sufficient amount of padding material separated from the excavated material. The rough material is placed behind the padding machine. The separator screen can be vibrated to increase the amount of fines passed through the separator. This device does not provide for screening during the initial conveying nor for attachment to vehicles, such as loaders and bulldozers.

U.S. Pat. Nos. 5,120,433 and 5,195,260, issued to Mark Osadchuk, disclose significantly improved pipeline padding machines of the general type disclosed in U.S. Pat. No. 4,633,602 to Layh et al. However, the type of padding machines disclosed in the Layh et al. and Osadchuk patents are generally large machines, which are intended and useful primarily for long-distance pipe laying operations in open country, where rights of way are relatively wide and where the terrain is not excessively rugged.

U.S. Pat. Nos. 5,097,610 and 5,261,171 issued to Bishop disclose a pipeline padding machine attachment. The Bishop padding machine attachment is removably attached to one end of a vehicle, such as a bucket loader, bulldozer, or other base machine, whereby the attachment moves along the path of travel of the vehicle. The padding machine attachment picks up at least a portion of a pile of excavated material along side the ditch and processes the excavated material into padding material for placement into the ditch for padding a cable or pipeline.

While the Layh et al., Osadchuk, and Bishop devices are suitable for their respective intended purposes, it is desirable to substantially increase the ability of a padding machine to separate fine padding material from excavated material. There has been a particularly long-felt need to increase this ability for small pipeline padding machines or pipeline padding machine attachment devices, which have the advantage of versatility and lower cost, but suffer from the disadvantage of inadequate padding material output for larger padding operations.

SUMMARY OF THE INVENTION

The present invention provides a padding machine for moving relative to excavated material piled alongside a ditch, processing the excavated material into relatively fine padding material and relatively rough residual material, conveying the padding material to the ditch for padding cable or pipeline. The padding machine preferably has an endless screening belt formed of moving bars, screen, or other openwork for lifting the excavated material. The openwork of the screening belt has spacings or openings formed therein so that as the excavated material is lifted upwardly, relatively fine material can pass through the openwork, which functions as a separator. Relatively large pieces of material cannot pass through the openwork. The fine padding material falls onto a discharge conveyor that laterally transports the padding material to the ditch for padding cable or pipeline. Preferably, the discharge conveyor can be laterally adjusted so that the padding material can be discharged to either side of the padding machine.

According to the invention, the padding machine is provided with a new shaker assembly that vigorously shakes the moving screening belt or other openwork. The shaker assembly includes resilient mounts for attaching the shaker assembly to the frame of the padding machine, preferably adjacent the supports for an upper portion of the screening belt, which slides across the top of such supports. The rubber or rubber-like resilient mounts support a an eccentric shaft that is journalled in associated bearings for rotation beneath an upper portion of the screening belt. The eccentric shaft preferably extends substantially the entire width of the screening belt to either side of the padding machine. A motor is connected to a drive end of the eccentric shaft for rotating the shaft. When the motor rapidly rotates the eccentric shaft, the off-center body of the eccentric shaft causes vibration, which is translated through the resilient mounts to the frame of the padding machine adjacent the supports for the screening belt. Thus, vibratory motion is imparted to the moving screening belt. The amount of the vibratory motion depends on the configuration of the shaker assembly, particularly the eccentric shaft, and the speed at which the shaft is rotated.

All else being about the same, the vigorous shaking of the screening belt as it moves the excavated material dramatically increases the amount of the relatively fine padding material that passes therethrough. For example, it was found that using a shaker assembly according to the present invention for a moving screening belt of a padding machine unexpectedly and surprisingly allows a screening belt with only ¼ inch square openings therein to process the same amount of material as was previously only possible with a screening belt having ¾ inch square openings. This means that a padding machine with a shaker assembly according to the present invention for the screening belt can be used to separate a greater amount of padding material from a given amount of excavated material, it can be used to separate a finer grade of padding material in the same amount of time previously required for a coarser grade, or a compromise of both advantages. The increased productivity translates to much lower operational costs to the cable or pipeline contractor.

The discharge conveyor is preferably at least partially underlying the moving screening belt so that fine padding material passing through the screening belt falls onto the discharge conveyor. The padding material can be further guided to the discharge material by a guiding chute or one or more conveyors positioned below the screening belt for transporting padding material to the discharge conveyor.

According to a most preferred embodiment of the invention, the shaker assembly is used in connection with a padding machine attachment, which can be removably connected to one end of a vehicle, such as a front-end loader, a bulldozer, or other prime mover. With the increased productivity attainable with the shaker assembly provided herein, a relatively small padding machine attachment can be used for larger padding operations than heretofore possible. The padding machine attachment according to the present invention also preferably includes its own diesel engine and a hydraulic power system, whereby the padding machine attachment can be removably connected to a prime mover vehicle without the necessity of attaching hydraulic fluid lines between the hydraulic motors of the attachment and the auxiliary hydraulic power of the vehicle. Thus, the padding machine attachment can be removably attached to one end of the prime mover vehicle and a remote control line passed to the operator cab of the vehicle, all in a matter of just two or three minutes.

Accordingly, it is an object and purpose of the present invention to provide a padding machine which operates to continuously process excavated material piled alongside a trench into relatively fine padding material and relatively rough residual material and to at least partially backfill the trench with the fine padding material. It is another object of the invention to provide a padding machine that has a new shaker assembly for a moving separator that increases the amount of fine padding material separated from the excavated material. Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED EMBODIMENTS OF THE INVENTION

Figure 1:
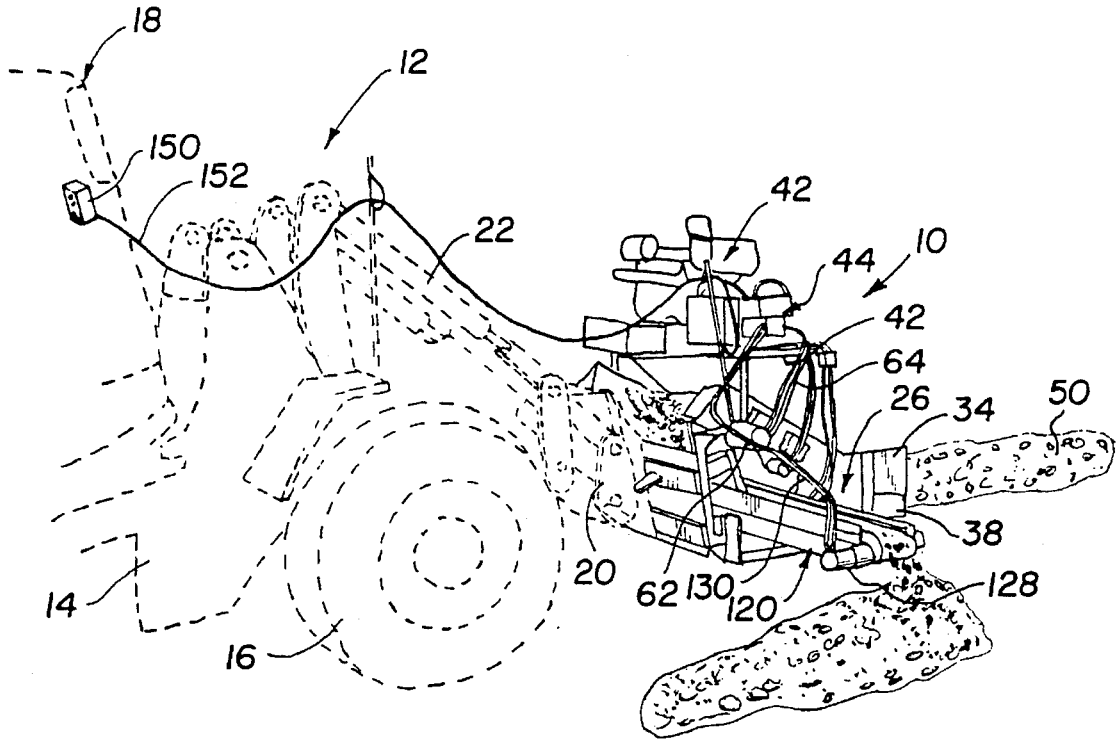
FIG. 1 is a perspective view from the side of a padding machine according to a preferred embodiment of the invention, which is a removable attachment for a vehicle, such as a front-end loader.
Figure 2:
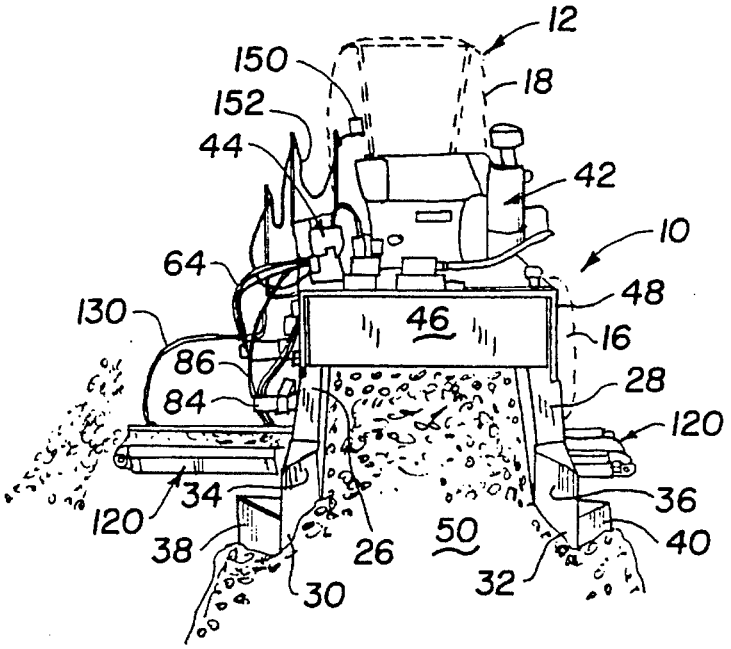
FIG. 2 is a front end view of the padding machine shown in FIG. 1.

Referring to FIGS. 1 and 2, there is illustrated a padding machine 10, which constitutes a preferred embodiment of the present invention. The padding machine 10 is preferably an attachment for a vehicle, such as a front-end loader, bulldozer, or other vehicle capable of moving in a pile of excavated material. The padding machine 10 illustrated in the drawing is an improvement of the padding machine shown in U.S. Pat. Nos. 5,097,610 and 526,171 to Bishop, the disclosures of which are hereby incorporated by reference in their entirety. However, it is to be understood that the improved shaker assembly disclosed herein can be used in self-contained padding machines such as those disclosed in the Layh et al. and Osadchuk patents discussed above.

As shown in FIGS. 1 and 2, the vehicle is represented by a front-end loader 12, which is shown in phantom lines. The front-end loader 12 has a base frame 14, tires 16, and an operator cab 18. A sub-frame 20 is pivotally attached to the vehicle base frame 14 at the front end of the vehicle 12. The sub-frame 20 can be selectively raised and lowered by a pair of piston-cylinder units 22. Normally, the sub-frame of the front-end loader 12 has a bucket (not shown) removably attached thereto. The bucket can be easily removed to facilitate attachment of the padding machine 10 to the sub-frame 20. Alternatively, the padding machine 10 can be hooked onto the bucket as previously described in U.S. Pat. Nos. 5,097,610 and 526,171 to Bishop. Thus, the vehicle 12 can be used for at least two different purposes, for example, as a front-end loader or as the prime mover for the padding machine 10.

As shown in the overview of the padding machine 10 shown in FIGS. 1 and 2, it preferably includes a generally angular frame 24. The angular frame 24 includes a pair of triangular side frame members 26 and 28. The side frame members 26 and 28 are connected by several cross members, including several bottom frame members or a solid plate, or a rear cross plate, and can include optional reinforcing members, cross bars, or safety bars. Additionally, the padding machine 10 includes a lip or blade which spans and connects the side frame members 26 and 28 at the forward end of the machine 10, and which is positioned to be located at ground level and to function as a cutting blade when the machine 10 is in operation.

Figure 3:
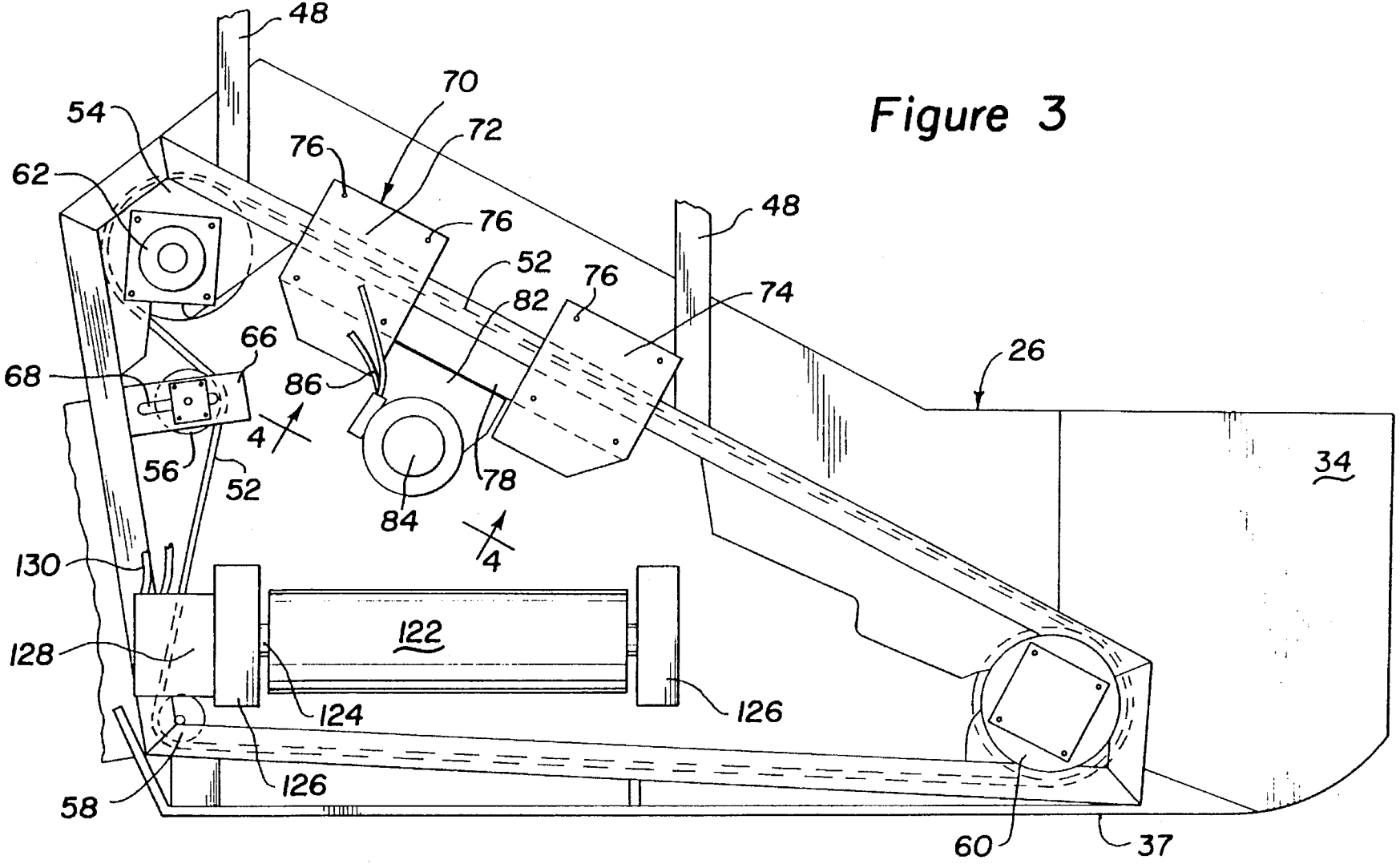
FIG. 3 is a side elevation view of a side frame member of a padding machine according to FIGS. 1 and 2 showing the attachment of the moving screening belt and shaker assembly to the frame member.

The side frame members 26 and 28 further include outwardly disposed guide projections 30 and 32 at their lower front ends, which function to collect and guide excavated material toward the center of the padding machine 10. These guide projections 30 and 32 are preferably unitarily formed with the side frame members 26 and 28. The guide projections flare outwardly from a center line which would bisect the padding machine 10. Each of the guide projections 30 and 32 include a ground engaging lower surface that is formed to be substantially parallel to the surface upon which the vehicle 12 rests. The guide projections include upwardly extending side guard portions 34 and 36, respectively, which prevents excavated material from spilling thereover, which might otherwise result in rough material falling into the ditch and damaging a cable or pipeline laid therein. Turning briefly ahead to FIG. 3, the bottom of the side members 26 and 28 have a smooth ground engaging lower surface 37 for skidding along the ground or the pile of excavated material 50.

Outwardly extending wing portions 38 and 40 are rigidly attached to the guide projections 30 and 32, respectively. Wing portions 38 and 40 are designed to clear a path behind the padding machine for the tires or tracks of the vehicle 12. The smoothed out surface provides a stable surface upon which the vehicle 12 can ride. This can help the vehicle 12 negotiate its way in or through the pile of excavated material and also helps control the depth of cut of the padding machine 10, which is one of the factors affected the amount of padding material obtained.

According to another aspect of the invention, a diesel engine 42, hydraulic system 44, and hydraulic fluid reservoir 46 are supported by an overhead structural support 48 in a location which is elevated above the rest of the padding machine 10. By placing the engine 42 above the rest of the padding machine, the amount of dust and dirt that it is exposed to during operation of the machine 10 is greatly reduced. The weight of the engine 42, hydraulic system 44, and hydraulic fluid reservoir 46 also serves to help force the padding machine to bite into a pile of excavated material 50 and gather the material between the guide projections 30 and 32.

As best shown in FIG. 3, the padding machine 10 further includes an screening belt 52. The screening belt 52 can preferably have a plurality of raised cross bars (not shown) on its outer surface, which function to assist in scooping earth and excavated material onto the screening belt 52. As used herein, a screen is intended to mean a type of framework or openwork with a plurality of openings selectable to be of a size for processing excavated material while permitting the passage through the openings of suitable pipeline or cable padding material and rejecting the passage of all other material as residual material. The terms "openwork" or "framework with a plurality of openings" are used in their broadest sense and include not only screens, but also their equivalence, such as space bars and other devices shown in the prior art or known to those skilled in the art.

The screening belt 52 travels over a plurality of rollers, such as the drive roller 54 that is located at the top and rear of the frame members 26 and 28, tension roller 56 located beneath and slightly forward of the drive roller 50, rearward, lower roller 58 located at the rearward, lower corner of the frame members 26 and 28, and forward, lower roller 60 located at the forward, lower end of the frame members 24 and 26. The rollers 54, 56, 58, and 60 are all journalled in associated bearings which are mounted on the side frame members 26 and 28.

The drive roller 54 is driven by a hydraulic motor 62 which is mounted on the side frame member 26. The hydraulic motor 62 is connected to the drive roller 54 by conventional means. As shown in FIGS. 1 and 2, the hydraulic motor 62 is connected through hydraulic hoses 64 to the hydraulic system 44. Thus, the hydraulic system 44 can be used to drive hydraulic motor 62, which in turn drives the screening belt 52. The speed of the screening belt can be variably adjusted ,to process more or less excavated material by changing the speed of the hydraulic motor 62. The hydraulic motor 62 is also reversible so that the screening belt 52 can be moved forward or backward. Thus, if the screening belt 52 becomes clogged with excavated material, which may sometimes occur when the material is wet, for example, moving the screening belt in the reverse direction can help unclog the machine 10.

The tension roller 56 is mounted to a support arm 66 on each of the side frame members 24 and 26. The support arm has a slot-like opening 68 therein so that the position of the tension roller 56 can be adjusted forward or rearward along the length of the slot-like opening 68. This allows the tension of the screening belt 52 traveling over the rollers 54, 56, 58, and 60 to be adjusted to the desired tension.

As shown in FIG. 3, the screening belt 52 travels in an endless path around the rollers 54, 56, 58, and 60. During normal operation, the screening belt 52 is operated so that it travels in a generally counter-clockwise direction from the perspective shown in FIG. 3. As a portion of the endless screening belt 52 moves from the forward, lower roller 60 at an inclined angle to the horizontal ground level up to the drive roller 54, excavated material 50 at the forward end of the padding machine is carried upwardly and rearwardly on the screening belt. As will hereinafter be described in more detail, the upper, inclined portion of the screening belt 52 is preferably supported on a plurality of runners to prevent it from sagging under the weight of excavated material.

However, it is to be understood that the padding machine 10 could have other configurations, for example, rather than supporting the screening belt at an angle as shown in FIG. 3, a screening belt could be supported to travel in a generally circular path.

An improved shaker assembly 70 is mounted to the side frame members 26 and 28 adjacent the upper portion of the screening belt 52 as it travels between the forward, lower roller 60 and the drive roller 54. The shaker assembly 70 is positioned on the side frame members 26 and 28 to shake the frame members, which support the screening belt 52 and thus in turn shakes the screening belt. Vigorously shaking the frame members 26 and 28, dramatically increases the amount of fine padding material that can be separated from a given amount of excavated material moving on the screening belt.

According to the presently preferred embodiment of the invention, the shaker assembly 70 includes energy absorbing mounts 72 and 74, which are connected to both side frame members 26 and 28. The mounts 72 and 74 are preferably formed of a resilient rubber or rubber-like material to absorb some of the mechanical stress of the vibration imparted by the shaker assembly 70 to reduce the stress on the connections between the shaker assembly 70 and the rest of the padding machine 10. The rubber mounts 72 and 74 are bolted or otherwise fastened to the side frame members, with, for example, a plurality of bolts 76.

A support plate 78 is bolted or otherwise connect to the mounts 72 and 74, for example, with a plurality of bolts 80. A shaft support member 82 is integrally formed on the support plate 78. The shaft support member 78 is for supporting a rotating eccentric shaft as will be described in more detail with reference to FIGS. 4 and 5. A hydraulic motor 84 is connected to side frame member 26 for driving the eccentric shaft. As shown in FIGS. 1–3 the hydraulic motor 84 is connected through hydraulic hoses 86 to the hydraulic system 44. Thus, the hydraulic system 44 can be used to drive hydraulic motor 84, which in turn drives the eccentric shaft to vibrate the screening belt 52. The speed of the hydraulic motor 84 can be variably adjusted to increase or decrease the rotation speed of the eccentric shaft and the vibration produced. Thus, the shaker assembly 70 can be used to control the separation of more or less relatively fine material from the excavated material by changing the speed of the hydraulic motor 84.

Figure 4:
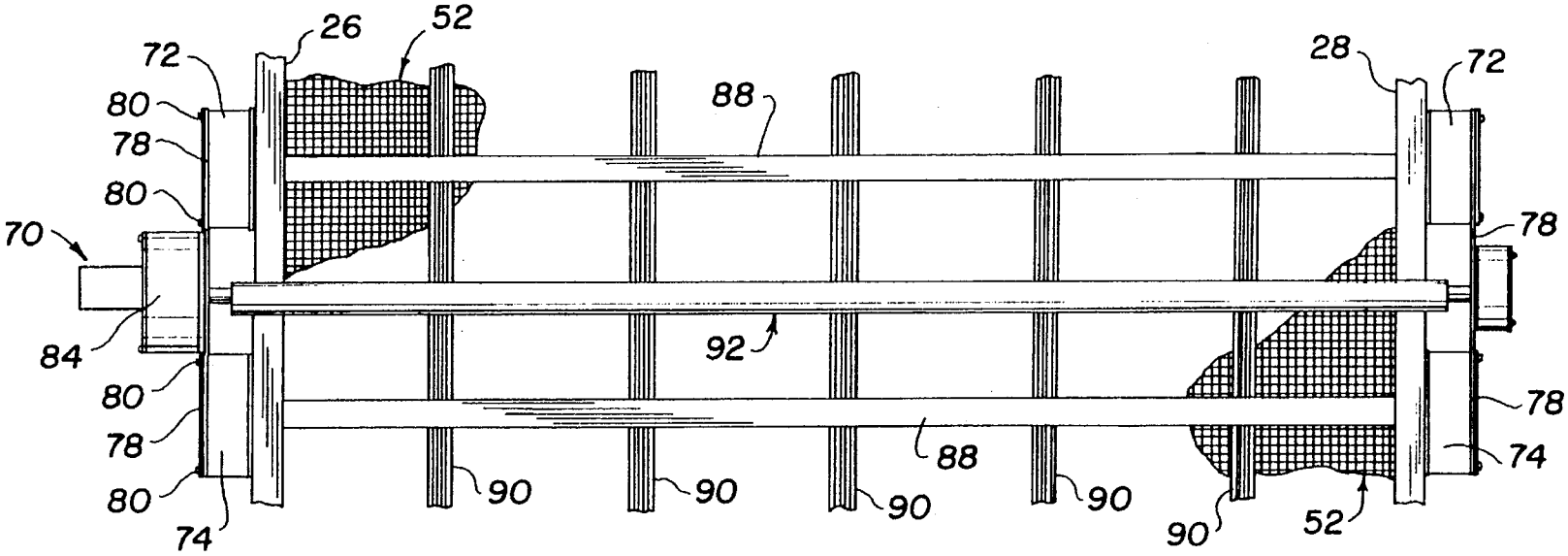
FIG. 4 is an upward looking view taken along lines 4—4 of FIG. 3 showing the shaker assembly and support structure for the moving screening belt of the padding machine shown in FIGS. 1 and 2.
Figure 5:
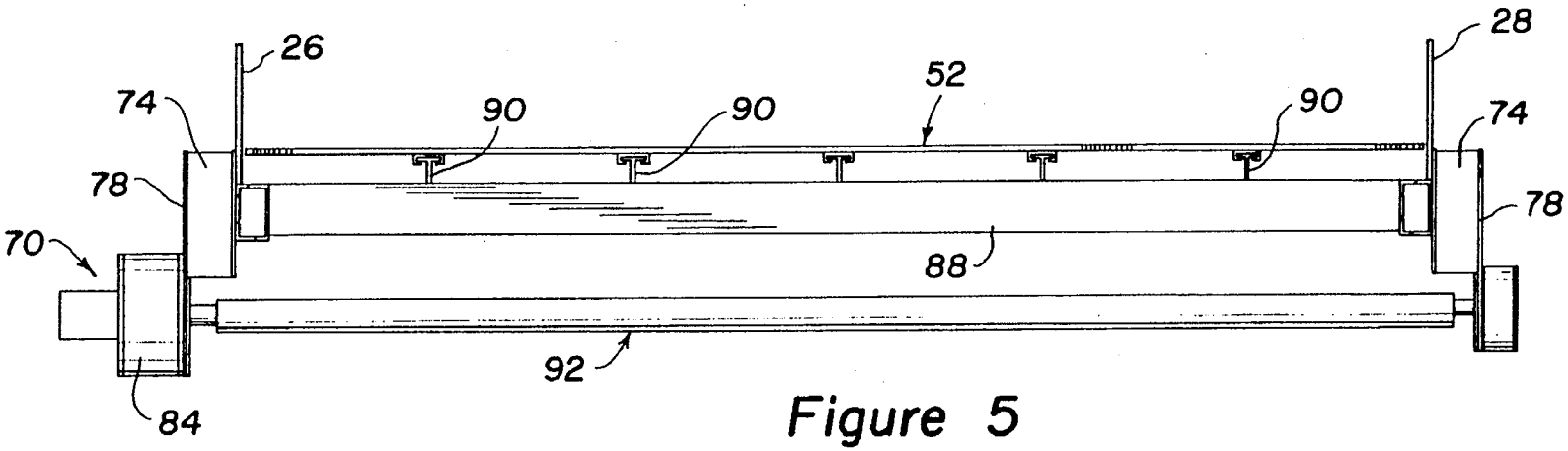
FIG. 5 is a front view of the shaker assembly shown in FIG. 4.
Figure 8:
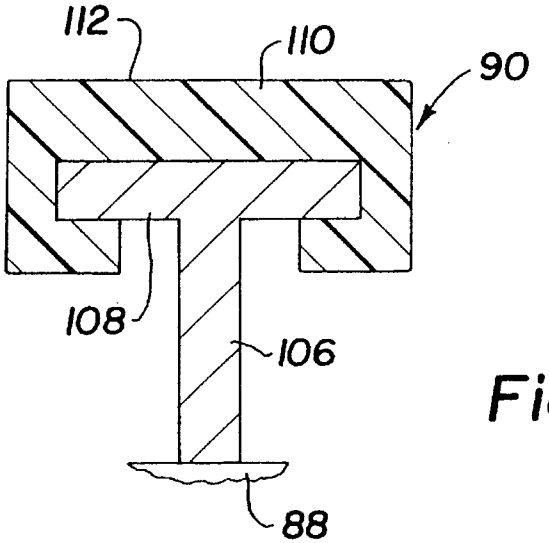
FIG. 8 is a detail view of the T-shaped support runner for the moving screenings belt and the wear strip positioned thereon.

Turning now to FIGS. 4 and 5 of the drawing, FIG. 4 shows the view that can be seen looking upwardly through the shaker apparatus 70 from inside the padding machine 10. A pair of cross-members 88 are positioned between the side frame members 26 and 28 to provide structural support to the padding machine 10.. The pair of cross members 88 support a plurality of runners 90 that run parallel to the direction of movement of the screening belt 52 and longitudinally support the screening belt as shown. The screening belt 52 is not connected to the runners 90, but slides over the runners as will be described in more detail in conjunction with FIG. 8. As can be seen in FIGS. 4 and 5, an eccentric shaft 92 is supported between the side frame members 26 and 28 by the shaft support members 78. Looking up through the cross members 88 and the longitudinal runners 90, a portion of the openwork of the screening belt 52 is represented as being supported above the runners 90.

Figure 7:
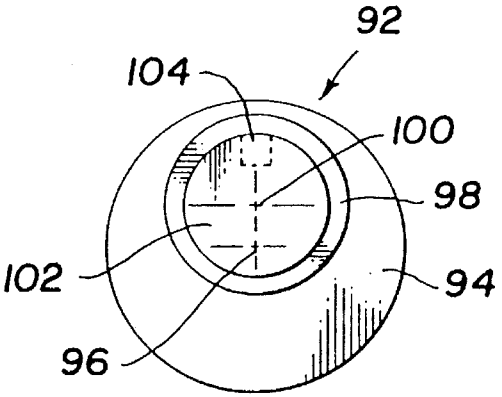
FIG. 7 is an end view of the drive end of the eccentric shaft of the shaker assembly shown in FIGS. 4–6.
Figure 6:
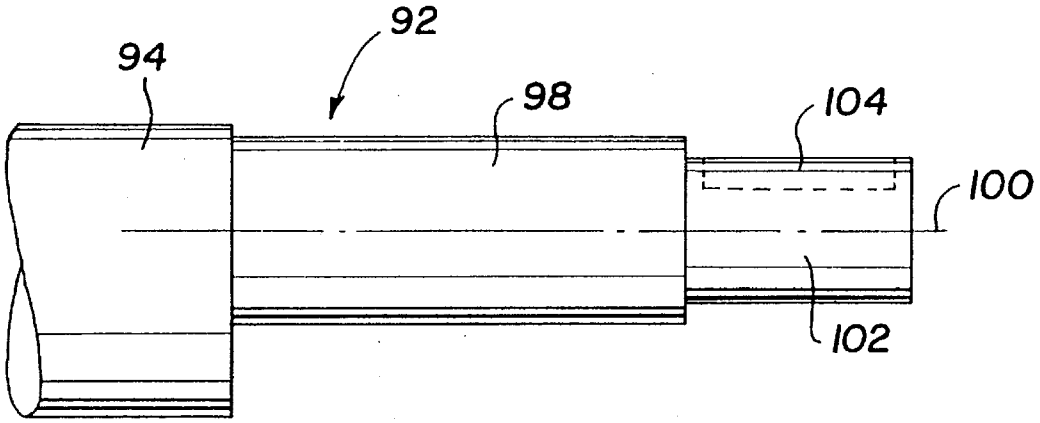
FIG. 6 is a side view detail of the drive end of the eccentric shaft of the shaker assembly shown in FIGS. 4 and 5.

Turning now to FIGS. 6 and 7, the structure and operation of the eccentric shaft 92 will be described in more detail. The drive end portion of the eccentric shaft 92 is shown in detail in FIG. 6, and an end view of the drive end portion is shown in FIG. 7. The eccentric shaft 92 has an elongated body portion 94 that is circular in cross-section and has a central axis 96 as best shown in FIG. 7. The drive end portion of the eccentric shaft 92 has a bearing portion 98, which is circular but smaller in cross-section than the body portion 94. The axis 100 of the bearing portion 98 is off-center from the axis 96 of the body portion of the shaft 92. The other end of the shaft 92 (not shown) has a similar bearing portion 98. The bearing portion 98 defines a surface for the bearings that support the shaft to ride on, so that the shaft 92 can be rotated in the shaft support plate 78 by conventional means.

The drive end portion of the eccentric shaft 92 shown in FIGS. 6 and 7 has a key portion 102, which the other end of the shaft 92 does not require. The key portion 102 has a slot or notch 104 formed therein that can be engaged by the hydraulic motor 84 to rotate the eccentric shaft 92. Thus, when the hydraulic motor 84 rotates the shaft about the axis 100 of the bearing portion 98 of the eccentric shaft 92, the body portion 94 is off-balance. Rapidly rotating the eccentric shaft causes rapid vibration in the shaker assembly 70. The frequency of this vibration is controlled by varying the speed of hydraulic motor 84.

The vibration caused by rotation of the eccentric shaft 92 is transferred through the rubber mounts 72 and 74 to the side frame members 26 and 28 and cross members 88 of the padding machine 10. The vibrating cross members support a plurality of longitudinal runners 90 as previously described, which in turn support the screening belt 52 as it slides along the top of the runners 90. Through these structural features, and under the weight of excavated material loaded onto the screening belt with forces it against the vibrating runners 90, vibration is imparted to the moving screening belt 52.

All else being about the same, the vigorous shaking of the screening belt 52 as it moves the excavated material dramatically increases the amount of the relatively fine padding material that passes therethrough. For example, it was found that using a shaker assembly according to the present invention for a moving screening belt of a padding machine allows a screening belt with ¼ inch square openings therein to process the same amount of material as was previously only possible with a screening belt having ¾ inch square openings. The degree of this improvement was not expected. This means that a padding machine with a shaker assembly according to the present invention for the screening belt can be used to separate a greater amount of padding material from a given amount of excavated material, it can be used to separate a finer grade of padding material, or both. The increased productivity translates to much lower operational costs to the cable or pipeline contractor.

The movement of the screening belt 52 across the vibrating runners 90 can cause tremendous wear, which would mean that the runners would have to be frequency serviced or replaced. To solve this problem, plastic wear strips are included with the runners 90 as shown in detail in FIG. 8 of the drawing. The runners have a generally "T" shaped configuration, including a vertical leg 106 and a horizontal support 108. The horizontal support 108 is covered by a replaceable plastic wear strip 110. The wear strip 110 has a generally "C" shaped configuration for engaging the horizontal support 108 of the runner 90. Thus, the vertical leg 106 of the runner 90 provides vertical support, and the horizontal strut 108 on the upper end of the leg 106 provides support for the plastic wear strip 110. The wear strip 110 defines a smooth upper surface 112 that is capable of withstanding the punishing vibration imparted by the shaker assembly 70. The wear strip 110 can be easily replaced as it is slowly worn away by the sliding screening belt across the upper surface 112 thereof.

The fine material that passes through the screening belt 52 is guided onto a discharge conveyor 120. The fine material can be guided to the discharge conveyor 120 by a chute, for example. Alternatively, the fine padding material can be guided by a secondary conveyor belt, such as the "inclined conveyor belt 42" disclosed in U.S. Pat. Nos. 5,097,610 and 5,261,171 issued to Bishop, which are incorporated herein by reference in their entirety.

The discharge conveyor 120 extends transversely with respect to the direction of travel of the padding machine 10. The discharge conveyor 120 is positioned directly beneath the upper end of the screening belt 52, so as to receive at least a portion of the fine padding material that passes through the screening belt 52. The discharge conveyor 120 has a conveyor belt 122 that travels on rollers 124 which are journalled to an elongated conveyor frame 126. A reversible hydraulic motor 128, mounted within the elongated conveyor frame 126, drives the discharge belt 122. The motor 126 is connected to the hydraulic system 44 through hydraulic fluid lines 130. The conveyor frame 126 rests on transverse support rails. The conveyor frame 126 and the discharge belt 122 may be slid in either direction on the support rails, so as to be extendible from either side of the padding machine 10. This arrangement enables screened fine padding material to be selectively discharged into a ditch to either side of the padding machine 10. Thus, the padding machine 10 can be used to pad a cable or pipeline when traveling in either direction along either side of a ditch.

Figure 9:
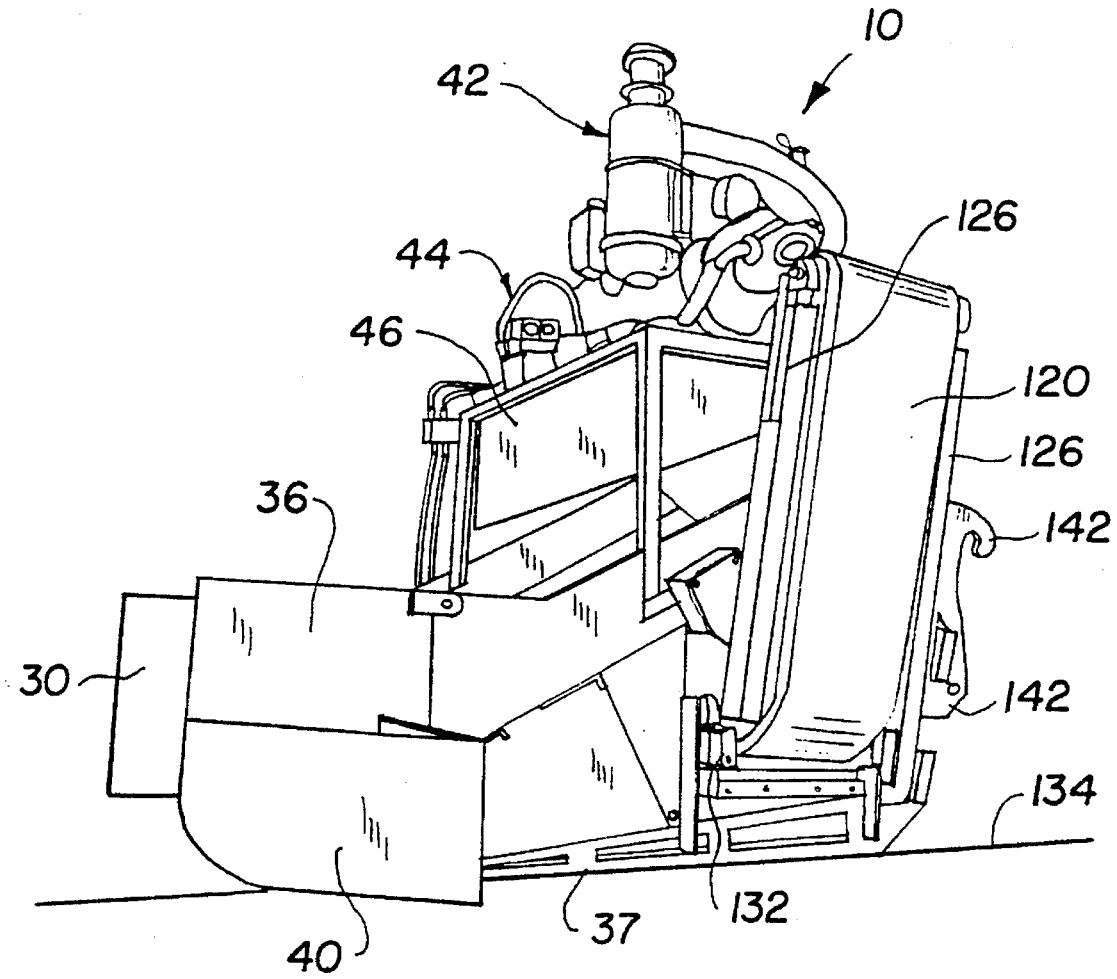
FIG. 9 is a perspective view of the padding attachment removed from a vehicle and resting on a surface, such as the ground or the flat-bed of a truck, wherein the side conveyor is moved into a stowed positioned for transport.

Referring to FIG. 9 of the drawing, the discharge conveyor preferably has a central pivot connection 132 so that the extended portion can be raised to a stowed position as shown. Thus, when the discharge conveyor is stowed vertically, the padding machine 10 is highly compact for storage or transport on a flat surface 134.

Continuing to refer to FIG. 9, the rear ends of the padding machine side frame members 26 and 28 each include ears 140, by which the padding machine 10 can be attached to the sub-frame 20 of a conventional loader 12 or other vehicle. The side frame members 26 and 28 also include hooks 142, by which the padding machine 10 can be engaged and supported by a bucket of a loader or bulldozer. The ears 140 or hooks 142 are adapted to receive the sub-frame of the vehicle 12 for removably and securely mounting the padding machine to the vehicle.

Turning back to FIGS. 1 and 2 of the drawing, the padding machine 10 preferably includes a remote control box 150, which is connected through an electrical line 152 to the engine 42 and hydraulic system 44 of the padding machine. When the padding machine is connected to a vehicle 12, the remote control line can be supported such that the remote control box 150 can be positioned inside the operator cab 18 of the vehicle 12. Thus, the operator can control every aspect of the padding machine from the cab 18. The control box 150 includes controls for the speed and direction of the hydraulic motor 62 for the screening belt 52, the speed of the hydraulic motor 84 for rotating the eccentric shaft of the shaker assembly 70, and the speed and direction of the hydraulic motor 128 for the discharge conveyor 120.

In operation, the padding machine 10 is attached to the front end of a vehicle 12, a loader, for example, as shown in FIGS. 1 and 2. The padding machine 10 is preferably powered by its own diesel engine 42 and hydraulic system 44 mounted to the padding machine. Thus, the padding machine 10 can be operated independently of the hydraulic system of the vehicle 12, which facilitates the attachment and removal of the padding machine to and from the vehicle 12.

The padding machine 10 is positioned with the lower front end at ground level, and is normally driven along the ridge or earth, or berm, that is formed adjacent a trench by conventional trench digging equipment. The lip and the guide projections 30 and 32 collect the earth and guide it onto the screening belt 52. The wings 38 and 40 clear a path for the tracks or tires 16 of the vehicle 12.

As the earth is carried up the screening belt 52, relatively fine padding material passes through the vibrating screening belt 52, where it is directed or transported onto the transverse discharge 120. The discharge conveyor 120 transports the fine padding material to the nearby trench or ditch. Rocks and relatively rough residual material are carried to the top of the screening belt 52 and are discharged onto the ground behind the padding machine, preferably between the forward path of the tracks or tires 16 of the vehicle 12. Screening belt 52 thus performs both the functions of a separator and an elevating conveyor. Alternatively, rocks may be collected in a bucket behind the padding machine, or they may be conveyed to one side or the other by the auxiliary device described below, or they may be carried towards a bar to force rock to either side and down a chute (not shown).

The shaker assembly 70 serves to break up clods of soil and excavated material and thereby facilitate its passage through the screening belt 52. The shaker assembly 70 is particularly useful where excavated material is damp or wet. It also dramatically increases the amount of fine padding material that can be separated from a given amount of raw excavated material. For example, all else being equal, it has been determined that the same amount of padding material can be obtained using a ¼ inch screening belt (a screening belt having ¼ inch square openings formed therein) that was previously obtainable using a ¾ inch screening belt with a hydraulic piston type vibrator of the type previously disclosed in U.S. Pat. Nos. 5,097,610 and 5,261,171. These unexpectedly improved results mean that a relatively small padding machine attachment can be used to perform much larger padding operations. Furthermore, the finer padding material obtained with the shaker assembly means better protection for the buried cable or pipeline.

Although the invention has described with reference to these preferred embodiments, other embodiments can achieve the same results. Variations and modifications of the present invention will be obvious to those skilled in the art and it is intended to cover in the appended claims all such modifications and equivalents.

What is claimed is:

1. A padding apparatus for padding underground cable or pipeline by continuously separating excavated material piled alongside an excavated ditch into relatively fine padding material and relatively rough residual material as the apparatus moves forward and placing the relatively fine padding material in the ditch, the apparatus comprising: a frame for supporting an endless screening belt in an endless path for lifting excavated material in an elevating direction, said screening belt having an openwork that allows relatively fine padding material to pass therethrough; a shaker assembly for shaking said frame adjacent said endless screening belt to increase the amount of fine padding material that passes through said openwork, said shaker assembly having resilient mounts for mounting an eccentric shaft to said frame adjacent a portion of said endless screening belt and a motor for rotating said eccentric shaft to cause vibratory motion that is translated through said resilient mounts to said frame and said screening belt; and a discharge conveyor positioned to receive the relatively fine padding material and convey the fine padding material to the ditch for padding cable or pipeline.

2. An apparatus according to claim 1, further comprising a vehicle for moving said frame relative to the pile of excavated material alongside the excavated ditch.

3. An apparatus according to claim 1, wherein said frame of the apparatus has forwardly extending guide projections thereon for guiding excavated material to said screening belt as said apparatus moves forward relative to the pile of excavated material alongside the excavated ditch.

4. An apparatus according to claim 1, wherein said screening belt has a width transverse to the endless path, the length of said eccentric shaft is substantially the width of said endless screening belt, and said shaft is positioned to extend across the width of said screening belt below an elevated portion of said screening belt.

5. An apparatus according to claim 1, wherein a portion of said endless screening belt is supported by a plurality of runners, said screening belt sliding across said runners.

6. An apparatus according to claim 5, further comprising disposable wear strips mounted to said plurality of runners, said wear strips defining a smooth upper surface for said screening belt to slide across, whereby said disposable wear strip can be replaced after said upper surface is worn away by said endless screening belt sliding thereacross.

7. An apparatus according to claim 6, wherein each of said disposable wear strips are formed of a plastic body and a have a generally "C" shaped configuration for engaging one of said plurality of runners.

8. An apparatus according to claim 5, wherein said frame has mounting means for attaching the apparatus to a prime mover for moving the apparatus relative to the pile of excavated material alongside the ditch.

9. A self-contained padding machine attachment for attachment to a sub-frame of a vehicle for moving with the vehicle along one side of a ditch to pick up at least a portion of a pile of excavated material placed parallel to and along the one side of the ditch and processing the excavated material into padding material for placement in the ditch, the padding attachment comprising: a frame; coupler releasably connecting said frame to the vehicle sub-frame whereby the vehicle sub-frame can raise and lower the padding machine attachment to control the amount of excavated material processed by the padding machine attachment; an endless openwork mounted to said frame for moving in an endless path, said endless openwork collecting and lifting excavated material and separating the lifted excavated material into padding material by passing padding material through said openwork; a shaker assembly resiliently mounted to said frame adjacent a portion of said endless openwork, said shaker assembly having a motor for rotating an eccentric shaft for vibrating said frame and said endless openwork to increase the amount of padding material passing through said openwork; and a discharge conveyor that is mounted to said frame whereby it receives padding material passed through said openwork and transports the padding material for placement in the ditch.

10. The padding attachment of claim 9, wherein said frame comprises a pair of side frame members connected by cross members.

11. The padding attachment of claim 10, wherein at least one of said side frame members has an opening through which the said discharge conveyor extends whereby padding material can be transported through said side frame member to the ditch.

12. The padding attachment of claim 11, wherein said side frame members are triangular and said endless openwork travels in a path that includes an upwardly inclined portion.

13. The padding attachment of claim 12, wherein said endless openwork has an inclined conveyor that is supported by said frame and positioned at least partially beneath the inclined portion of said endless openwork whereby padding material that is passed through said inclined portion of said endless openwork is carried upwardly and transferred to said discharge conveyor.

14. The padding attachment of claim 9, wherein said eccentric shaft extends substantially the width of said endless openwork.

15. An apparatus according to claim 9, wherein a portion of said endless screening belt is supported by a plurality of runners, said screening belt sliding across said runners.

16. The padding attachment of claim 15, further comprising disposable wear strips mounted to said plurality of runners, said wear strips defining a smooth upper surface for said screening belt to slide across, whereby said disposable wear strip can be replaced after said upper surface is worn away by the endless screening belt sliding thereacross.

17. An apparatus according to claim 9, wherein said frame of the apparatus has forwardly extending guide projections thereon for guiding excavated material to said screening belt as said apparatus moves forward relative to the pile of excavated material alongside the excavated ditch.

18. An apparatus according to claim 17, wherein said guide projections have upwardly extending portions to prevent excavated material from spilling thereover.

19. An apparatus according to claim 17, wherein said guide projections have outwardly extending wings for clearing a path for the forward moving tracks or wheels of the vehicle.

* * * * *

UNITED STATES PATENT AND TRADEMARK OFFICE
CERTIFICATE OF CORRECTION

PATENT NO. : 5,540,003

DATED : July 30, 1996

INVENTOR(S) : Mark Osadchuk

It is certified that errors appear in the above-identified patent and that said Letters Patent is hereby corrected as shown below:

In Column 3, line 13, after "support" delete "a";

In Column 5, line 5, change "526,171" to – 5,261,171 –;

In Column 6, line 46, after "adjusted" delete comma before "to";

In Column 8, line 38, delete "with";

In Column 11, line 39, after "and" delete "a"; and

In Column 11, line 50, delete "the". (1st occurrence)

Signed and Sealed this

Twenty-fifth Day of February, 1997

*Attest:*

Bruce Lehman

BRUCE LEHMAN

*Attesting Officer*

*Commissioner of Patents and Trademarks*